US005449025A

United States Patent [19]

Weinberg

[11] Patent Number: 5,449,025

[45] Date of Patent: Sep. 12, 1995

[54] METHOD OF SHED OPENING OF PLANAR WARP FOR HIGH DENSITY THREE DIMENSIONAL WEAVING

[75] Inventor: Amotz Weinberg, Tel-Aviv, Israel

[73] Assignee: Shenkar College of Textile Technology & Fashion, Ramat Gan, Israel

[21] Appl. No.: 121,477

[22] Filed: Sep. 16, 1993

[51] Int. Cl.[6] ..... D03C 13/00; D03D 41/00

[52] U.S. Cl. ..... 139/11; 139/DIG. 1; 139/18; 139/55.1

[58] Field of Search ..... 139/5, 11, 18, DIG. 1, 139/55.1, 192; 428/225

[56] References Cited

U.S. PATENT DOCUMENTS 4,903,737 2/1990 Bottger et al. ..... 139/192 X
5,080,141 1/1992 Bottger et al. ..... 139/383 R
5,224,519 7/1993 Farley ..... 139/11

FOREIGN PATENT DOCUMENTS 1-246442 10/1989 Japan ..... 139/11

*Primary Examiner*—Andrew M. Falik
*Attorney, Agent, or Firm*—Keck, Mahin & Cate

[57] ABSTRACT

Methods for weaving three-dimensional fabric structures which have a desired cross-sectional shape and devices for such weaving in each of two mutually perpendicular directions allow sheds to be formed in planar warps. The sheds enable the insertion of parallel weft yarns through rows of warp yarns. High density three-dimensional fabrics which may be used in the manufacture of advanced composite materials can be woven.

6 Claims, 3 Drawing Sheets

CLOSED SHED

OPEN SHED

CLOSED SHED

OPEN SHED

STEP 33
COMB 5ax INSERTION

STEP 34
SHED CLOSED

STEP 35 & 8
COMB 5bx IS REMOVED
COMB 5ay BEATS-UP

STEP 30

STEP 31
SHED OPENING

STEP 32
WEFT INSERTION

METHOD OF SHED OPENING OF PLANAR WARP FOR HIGH DENSITY THREE DIMENSIONAL WEAVING

FIELD OF THE INVENTION

The present invention relates to three dimensional (3-D) woven fabrics produced by planar warps or different cross section. Since, in the proposed invention, the woven yarns in each direction are not bent, it is particularly suitable for industrial scale production or 3-D reinforced composite materials.

BACKGROUND OF THE INVENTION

A textile composite is a combination of a resin system with textile fibers (fibers, yarns or labrican, The textile component provides the tensile strength and rigidity. This is due to the molecular orientation of the fiber resulting in a strong and stiff element in the fiber direction. High performance fibers posses high strength or high modulus properties. The most important high performance fibers are composed of glass, graphite, aramid, polyethylene, boron, ceramic or steel. The resin or the matrix component holds the textile reinforcement in a prescribed suspension, provides rigidity and helps to distribute external loads on the material through the fibers. The matrix also protects the fibers from external injury and environmental effects (corrosion, radiation, etc.).

Composite materials produced from high performance fibers are called high performance composites. Such materials are becoming increasingly important in aerospace and aircraft application due to their high-strength and stiffness-to-weight ratios, Most advanced composites are formed by stacking (laminating) layers of fabric and then bonding them together to one solid structure, The layers may consist of fabrics, tapes, mats or unidirectional fibers laid in several directions. The weakness of the laminated structure is in its tendency to delaminate.

In order to overcome the weakness of delamination, It Is necessary to reinforce the composite structure in three dimensions. One way of achieving it is by using tile non-woven technique. This technique involves "felting" of short-length fibers so that the fibers interlace in three dimensions. The interlacing can be performed by two dimensional punching of short fibers web with needles that orient some of the fibers in the third dimension. When using very short fibers, it is possible to blend the fibers with the resin and process it in conventional polymeric machines such as extruder or injection molder.

The major limitations of the composites made in this way from short fibers are the lack of control on the fiber orientation and the mechanical inferiority of short fibers relative to continuous filaments. Non-woven structures offer limited design or shaping capability but are simple and cheap to produce.

Three dimensional (3-D) fabrics for structural composites are fully integrated continuous fiber assemblies having fiber orientation in the X, Y and Z dimension. Composites made from 3-D fabrics are superior in withstanding multidirectional mechanical stresses and thermal stresses. The three basic classes of integrating fibers, in yarns form, to 3-D structures are braiding, knitting and weaving.

In braiding, fabric is constructed by intertwining or orthogonal interlacing of two or more yarn systems to form an integral structure. The yarns are fed continuously from coned packages to the braiding machine. A 3-D braiding system can produce thin and thick structures in a wide variety of complex shapes. Fiber orientation can be chosen and 0° longitudinal reinforcement can be added, but a true three mutually perpendicular axes of straight yarn segments cannot be achieved.

Knitted fabrics are interlooped structures. The knitting loops are produced either by feeding the yarn in the cross machine direction (weft knit) or along the machine direction (warp knit). The latter is more suitable for 3-D composite reinforcement. Multiaxial warp knit structures consist of warp yarns at 0°, wart yarns at 90' and other yarns at an angle ±0 to the warp yarn direction. These yarns are held together by a chain of tricot stitches. The knitting process involves bending of the yarn in the knitting needle and sometimes piercing of the needles through the yarn layers. Both operations are not recommended for brittle yarns such as glass, boron and graphite.

3-D woven fabrics can be produced by conventional weaving, using multiple warp. The number of layers (warps) used in this method is limited by the friction resulting from the shedding motion and beat-up motion. Using this method, various yarn architectures can be woven. Orthogonal 3-D weaving can be fabricated by maintaining one stationary axis and inserting the yarns orthogonal to the axial yarn's system In an alternating manner. The same method is used for the formation of a tubular 3-D fabric. The advantage of the orthogonal weaving is in the linear yarn reinforcement in all directions. Bending or kinking the reinforcing yarns can cause deterioration in the mechanical properties of the composite material. However, the insertion of the orthogonal yarns through the yarns of the stationary axis, may produce technological problems and even damage to the stationary yarns.

Such a method of weaving is described in the U.S. Pat. No. 3,834,424 to Fukuta et al. King in U.S. Pat. No. 4,001,478 disclosed another method to form a 3-D structure of rectangular cross-section. U.S. Pat. No. 5,085,252 by Mohamed et al. describes a method of forming variable cross-section shaped 3-D fabrics. These patents and others emplby various techniques of inserting weft yarns through a planar array of warp yarns. When the array consists of a population of highly densed warp yarns, which is the case when high volume ratio of fibers is required, the weft Insertion operation can cause injury to the warp yarns.

SUMMARY OF THE INVENTION

There is provided a method for weaving a three-dimensional fabric structure having a predetermined cross-sectional shape comprising the steps of: Providing an aligned and tensioned array of planar warp yarns possibly arranging them into layers in two planar, ;mutually perpendicular directions, providing a reed and separating the layers of warp by turning said reed, forming a shed in one direction, inserting parallel weft yarns through the shed, beating the weft yarns by means of a comb, and repeating the last three steps in the other planar direction, so as to form three dimensional structure.

In accordance with the present invention, there is provided a method of forming sheds between layers of planar warp yarns, so that the orthogonal weft yarns can easily be inserted in any predetermined directions.

The planar warp yarns are threaded through two parallel and perforated plates. The distance between the two parallel plates is large enough to accommodate the shedding and the weft insertion devices. The top plate can slide on the warp yarns. The base plate is used to anchor the ends of the warp yarns.

BRIEF DESCRIPTION OF THE DRAWING

The invention is described by way of illustration with reference to the enclosed schematical Figures, which are not according to scale and in which.

DESCRIPTION OF THE PREFERRED EMBODIMENT

Figure 1A:
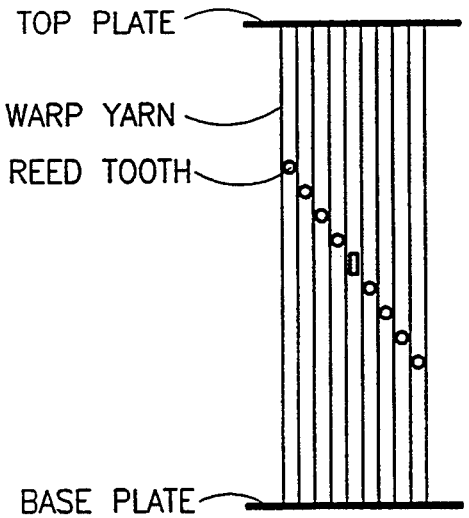
FIG. 1*a* illustrates a closed shed of a parallel layer of warp yarns
Figure 1B:
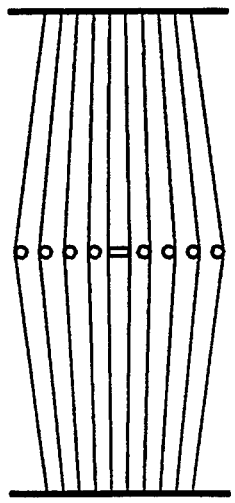
FIG. 1*b* illustrates an open shed of s parallel layer of warp yarns

The shedding operation is performed by two reeds. Each layer of the warp yarns is threaded through one slot in the first reed. As can be seen in FIG. 1*b*, the reed then divides the planar array of the warp yarns into lines or layers. The reed is located at a predetermined distance from the surface of the weave. However, as can be seen in FIG. 1*b*, when the plane of the reed is in right angle to the warp yarns, it spreads the layers of the warp yarns threaded through it so that the layers, initially parallel to each other, are not so any more, The displacement of the layers depends upon the distance between two consecutive slots of the reed and upon the distance between the reed and the fabric structure. The reed can be turned around an axis parallel to its slots. When the reed is turned, the warp layers slide against its teeth arid the distance between them becomes smaller. At a certain turning angle of the reed, the warp layers are parallel to each other. This position is called "closed shed" (FIG. 1*a*). In order to fully open the shed, the reed is turned to the position where its plane is perpendicular to the warp yarns in the fabric. This position is called "open shed" (FIG. 1*b*). In the open shed position (FIG. 1*b*) it is possible to insert weft yarns underneath the teeth of the reed. These yarns can be beaten up to form a unidirectional layer of yarns in the 3-D fabric.

Since the layers of the warp yarns, threaded through the central slots of the reed, are displaced by a magnitude equal to the thickness of the reed tooth, It may be necessary to use a center tooth of oblong cross section to ensure the required displacement or these layers.

A second reed is situated above the first one. When the planes of the reeds are mutually parallel and perpendicular to the warp yarns in the fabric, the slots or the second reed are oriented at an angle close to or equal to 90° to the slots of the first reed. Each of the planar warp yarns may be threaded to a different slot combination in the reeds. The second reed can be turned in a similar manner to the first one but its rotational axis is perpendicular or close to perpendicular to the rotational axis or the first reed. Since the second reed is located further away from the fabric than the first reed, the angle of the warp layers produced when it is in an open shed position is smaller than the angle of the open shed of the first reed.

To compensate for the discrepancy in the angle, the distance between adjacent teeth-of the second reed should be larger by $(R1 \times B)/A$ than the distance between adjacent teeth of the first reed, where R1 is the distance between adjacent slots of the first reed, A is the distance of the rotational axis of the first reed from the plain of the fabric and B is the distance between the axes of the reeds. When both reeds are turned to the extent of close shed, all the warp yarns are parallel to each other.

Figure 2A:
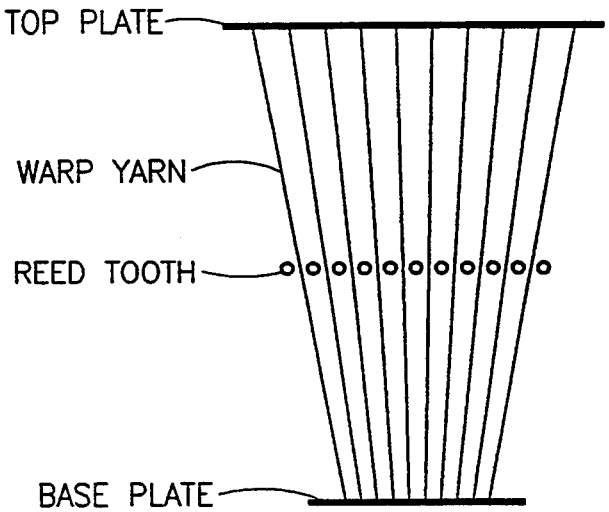
FIG. 2*a* illustrates an open shed of a trapezoidal layer of warp yarns
Figure 2B:
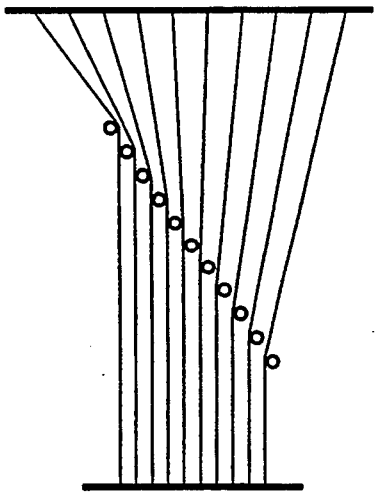
FIG. 2*b* illustrates a closed shed of a trapezoidal layer of warp yarns

FIG. 2*a* and FIG. 2*b* illustrate an alternative shedding operation that can be performed by threading the planar warp yarns, through two perforated plates, in a conical geometry. The number holes per unit area in the top sliding plate is lower than the that of the base plate. Each layer of the warp yarns, in between the plates, is threaded through one slot in the first reed. The reed then divides the planar array of the warp yarns into lines or layers. The reed is located at a predetermined distance from the surface of the weave. When the plane of the reed is parallel to the plates, the layers of the warp yarns threaded through it are spread. The reed can be turned around a central axis parallel to its slots. When the reed is turned, the warp layers are sliding against its teeth and the distance between them becomes smaller. At a certain turning angle of the reed, the warp layers are parallel to each other. This position is called "closed shed". In order to fully open the shed, the reed is turned back to the position where its plane is parallel to the plates. This position is called "open shed".

MODE FOR CARRYING OUT THE INVENTION

Figure 3:
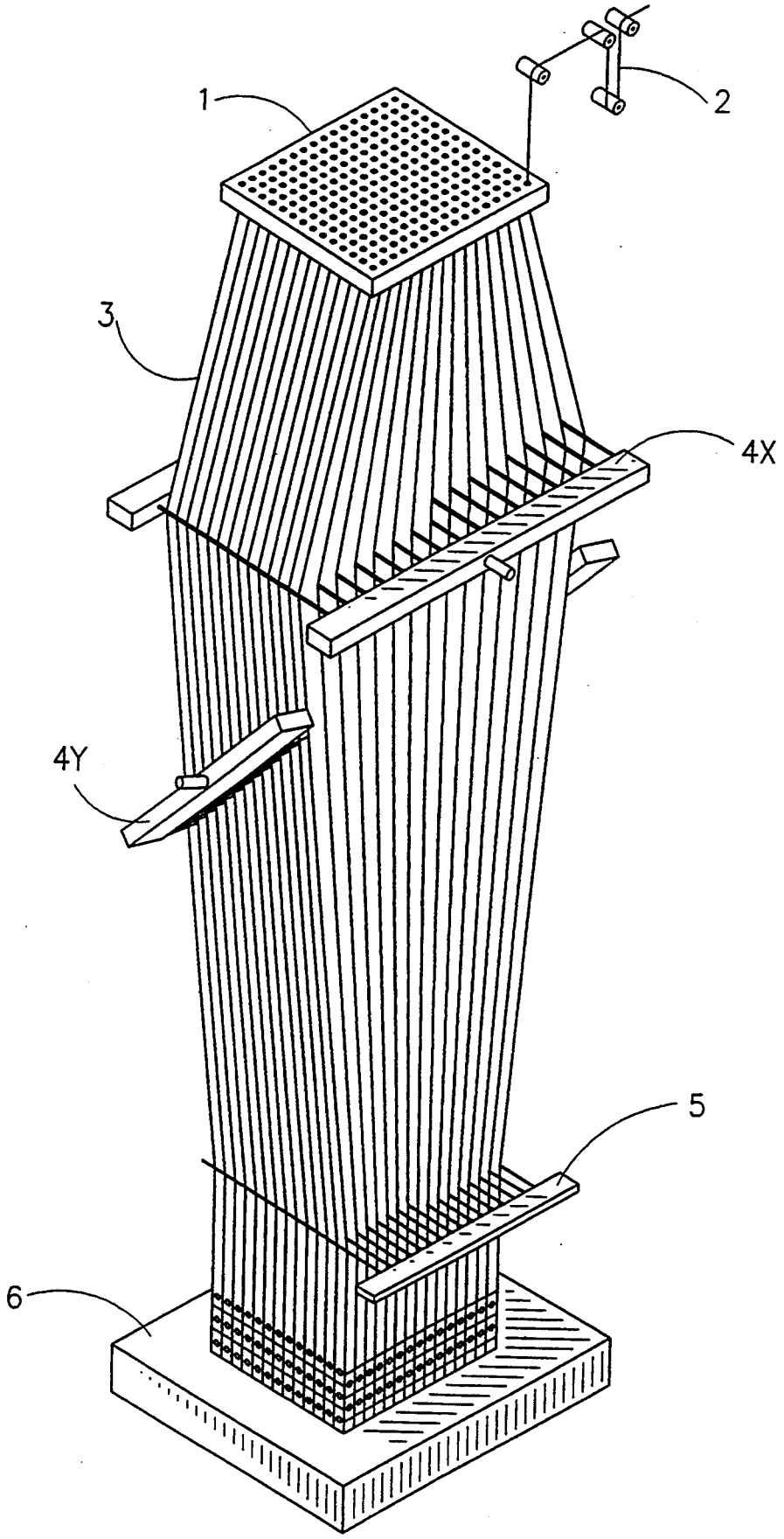
FIG. 3 is a schematic perspective illustration of the elements of the warping.
Figure 4D:
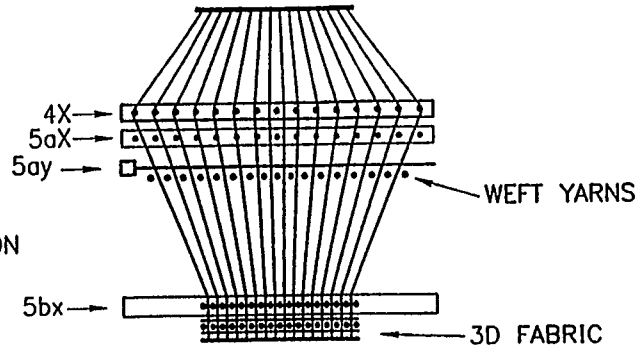
FIGS. 4*a*–4*f* are schematic illustrations of Step 8 and Steps 30 to 35.
Figure 4E:
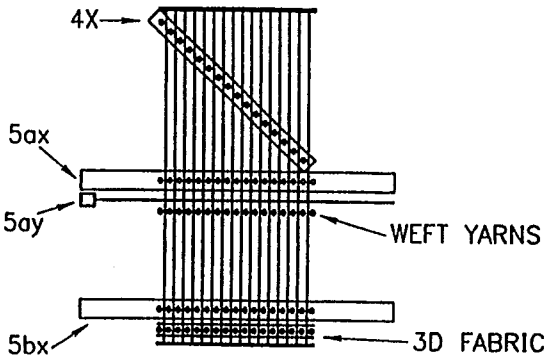
Figure 4F:
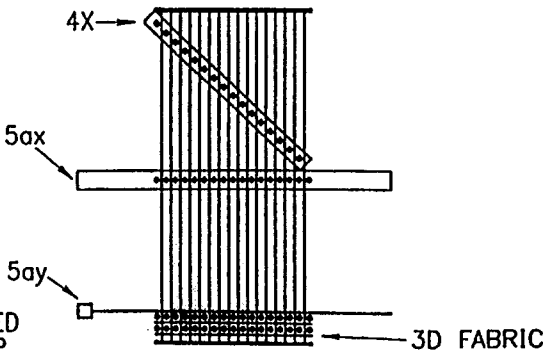
Figure 4A:
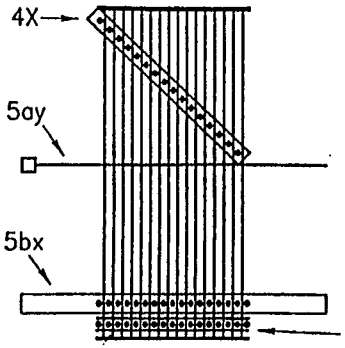
Figure 4B:
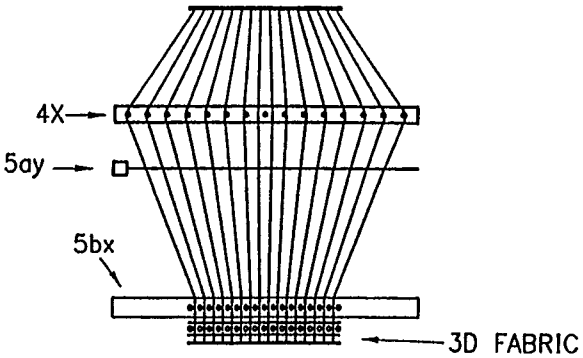
Figure 4C:
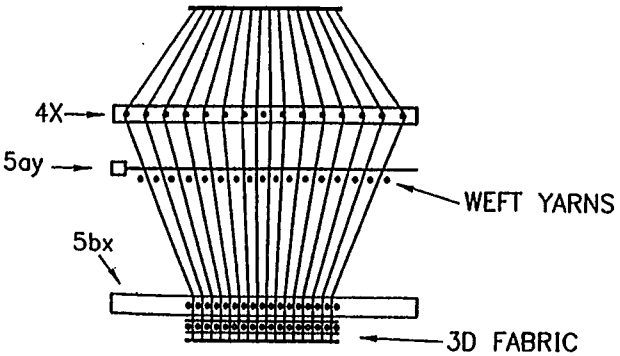

The first operation in 3-D weaving according to this invention is the planar warping. FIG. 3 describes the elements of the warping. Warp yarns 3, sized or unsized, are drawn from creels (not shown) and a tensioning device 2 (shown for one yarn only). Each yarn is threaded through the top perforated plate 1, then through a slot in the upper reed, 4X, and through a slot through the bottom reed 4Y. Finally, each yarn is threaded through the base perforated plate 6 and fastened to its bottom surface by means of knotting, bonding or mechanical clamping. The density of threading in the X and Y direction can be varied, by varying hole sizes and spacing in plate 1 of FIG. 3, to suit composites with different yarns in various directions. The density or the reeds and combs described below must correspond with the density of the holes in plate 1. By altering the length or breadth of the area covered by the holes in plate 1 of FIG. 3, the cross sectional shape of the 3-D composite can be modified. Beat up combs 5 consist of teeth with variable, but equal, spacing. They are used in either their open or closed spacing. The minimum spacing corresponds to the distance between two adjacent warp yarns, in a row, in the closed shed position. The maximum spacing is equal to the reed spacing.

The distance between the two parallel plates 1 and 6 is large enough to accommodate the reeds and the combs 5 for the beat up operation, This distance of the perforated plate 1 from the newly formed fabric surface remains constant. This is achieved by a gradual sliding of the perforated plate 1 on the warp yarns as plate 6 is moved down.

The following sequence of motions can be carried out in the weaving process:

1. Reed 4Y is turned to form an open shed in the Y direction.

2. Comb 5ay, with its teeth displaced, is inserted through the open shed under the reed 4Y.

3. Reed 4Y is turned back to close the shed in the Y direction. The teeth of the comb Say close down to meet the density of the warp yarns in the X direction.

4. Reed 4X is turned to form an open shed in the X direction.

5. Parallel weft yarns are inserted, in the X direction, through the open shed of rows of yarns,-under the comb 5ay.

Possible weft insertion can be a rapier mechanism, air pressure, knitting needles, tube guides or others. Using knitting needles (latch needles) to engage weft yarns on one-side of the warp and pull them through the open shed to the other side, is advantageous. It saves trimming the selvage of the yarns inserted. By this method, selvage loops are formed. However, this mode or weft insertion introduces folded weft yarns in each insertion and brittle yarns, such as graphite or glass yarn, may not withstand the bending motion in the eye of the knitting needle.

6. Comb 5ax, with its teeth in open spacing, is inserted through the open shed under the reed 4Y and above the comb 5ay.

7. Reed 4X is turned back to close the shed. Teeth of comb 5ax are put into closed spacing.

8. Comb Say is moved down to beat up the weft yarns.

9. Comb Say is moved up slightly above the surface of the fabric to protect its structure when the shed is farmed in the Y direction.

10. Reed 4Y is turned to form an open shed in the Y direction.

11. Parallel weft yarns are inserted in the Y direction.

12. Comb 5by, with its teeth in open spacing, is inserted through the open sheds under the reed 4Y and above comb 5ax.

13. Reed 4Y is turned back to close the shed. Teeth of comb 5by are put into closed spacing.

14. Comb Say is pulled out.

15. Comb 5ax is moved down to beat up the weft yarns.

16. Comb 5ax is moved up slightly above the surface of the fabric to protect its structure when the shed is formed in the X direction.

17. Reed 4X is turned to form an open shed in the X direction.

18. Parallel weft yarns are inserted, in the X direction, through the open shed of rows of yarns, under the comb 5by.

19. Comb 5bx, with its teeth In open spacing, is inserted through the open shed under the reed 4Y and above the comb 5by.

20. Reed 4X is turned back to close the shed. Teeth of comb 5bx are put into closed spacing.

21. Comb 5ax is pulled out.

22. Comb 5by is moved down to beat up the weft yarns.

23. Comb 5by is moved up slightly above the surface of the fabric to protect its structure when the shed is formed in the Y direction.

24. Reed 4Y is turned to form an open shed in the Y direction.

25. Parallel weft yarns are inserted in the Y direction.

26. Comb 5ay, with its teeth in open spacing, is inserted through the open sheds under the reed 4Y and above comb 5bx.

27. Reed 4Y is turned back to close the shed. Teeth of comb Say are put into closed spacing.

28. Comb 5by is pulled out.

29. Comb 5bx is moved down to beat up the weft yarns.

30. Comb 5bx is moved up slightly above the surface of the fabric to protect its structure when the shed is formed in the X direction.

31. Reed 4X is turned to form an open shed in the X direction.

32. Parallel weft yarns are inserted, in the X direction, through the open shed of rows of yarns, under the comb 5ay.

33. Comb 5ax, with its teeth in open spacing, is inserted through the open sheds under the reed 4Y and above comb 5ay.

34. Reed 4X is turned back to close the shed. Teeth of comb 5ax are put into closed spacing.

35. Comb 5bx is pulled out.

36. Back to stage 8 to complete the cycle of fabric formation. In each cycle either 1-30 for the first cycle or 31-35 and 8-30 for subsequent cycles, four layers or weft yarns, perpendicular to the warp yarns, are inserted.

It should be emphasized that the reed 4Y (the bottom reed) can be design to have teeth with adjustable and variable density. Such reed, although mechanically more complicated to construct, may be used for the beat-up motion.

It will be understood that the various details of the Invention may be changed without departing from the scope of the invention. Furthermore, the foregoing description is for the purpose of illustration only and does not limit the claims.

I claim:

1. A method for weaving a three-dimensional fabric structure having a predetermined cross-sectional shape comprising the steps of:

providing an aligned and tensioned array of planar warp yarns arranging said yarns into layers in two planar, mutually perpendicular directions in different reeds, forming a shed in one said planar direction, inserting parallel weft yarns through the shed, beating the weft yarns by means of a comb, and repeating the last three steps in the other said planar direction, for forming a three-dimensional structure.

2. A method according to claim 1 which comprises providing various cross-sectional shapes of the warp, to form three dimensional fabrics of various cross sections.

3. A method according to claim 1 which comprises effecting various patterns of threading of the warp yarns in the reeds for forming different fabric structures.

4. A method according to claim 1, which comprises effecting a different order of weft insertion for attaining enhanced reinforcement in a predetermined direction.

5. A method according to claim 1, which comprises applying selective weft insertion.

6. A system for carrying out a method defined in claim 1, comprising:

a tensioning device for the warp yarns where a constant static tension is applied on each yarn through a pulley and a weight, a top perforated plate for receiving each of the planar warp yarns threaded therethrough, according to the density and the cross-sectional shape required for the warp yarns, said different reeds comprising upper and lower reeds each provided with a slot, the width of each reed determining the maximum shed width obtainable by the reed, said comb means comprising beat up combs for beating newly inserted weft yarns, and a bottom perforated plate to which each of the warp yarns is attached.

* * * * *